US008037803B2

(12) United States Patent
Friedman et al.

(10) Patent No.: US 8,037,803 B2
(45) **Date of Patent: *Oct. 18, 2011**

(54) BLAST PROTECTION SYSTEM

(75) Inventors: Keith Friedman, Santa Barbara, CA (US); D. Erich Weerth, San Jose, CA (US)

(73) Assignee: Friedman Research Corporation, Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/807,043

(22) Filed: Aug. 25, 2010 (Under 37 CFR 1.47)

(65) Prior Publication Data

US 2011/0005381 A1 Jan. 13, 2011

Related U.S. Application Data

(63) Continuation of application No. 12/148,522, filed on Apr. 17, 2008, now Pat. No. 7,806,037, which is a continuation-in-part of application No. 11/589,619, filed on Oct. 30, 2006, now abandoned, which is a continuation-in-part of application No. 10/924,431, filed on Aug. 23, 2004, now abandoned.

(51) Int. Cl.
*F41H 5/04* (2006.01)
*B32B 5/12* (2006.01)

(52) U.S. Cl. ..... 89/36.01; 89/36.02; 89/904; 89/914; 109/80; 428/113

(58) Field of Classification Search ..... 89/36.01, 89/36.02, 36.04; 109/78, 80, 82, 83, 84; 428/113

See application file for complete search history.

(56) References Cited

U.S. PATENT DOCUMENTS 7,806,037 B2 * 10/2010 Friedman et al. ..... 89/36.01

* cited by examiner

*Primary Examiner* — Bret Hayes
(74) *Attorney, Agent, or Firm* — Mark Rodgers

(57) ABSTRACT

This invention is a novel system for blast protection. It consists of lightweight, sectional or continuous barriers made of a novel blast resistant fiber reinforced polymer resin matrix composite, which may be fabricated on site. The barriers are lightweight and thin enough that they may be used in many spaces where barriers made from conventional construction materials are impossible, impractical, or undesirable. The novel barriers of this invention have the additional advantage of allowing for aesthetically appealing and architecturally harmonious designs. In order to minimize weight, the barriers may be designed such that the cross section varies with height, providing adequate resistance in areas of high blast loading, but allowing for thinner cross sections in regions of lowering load.

4 Claims, 8 Drawing Sheets

BLAST PROTECTION SYSTEM

RELATED APPLICATIONS

This application is a continuation of U.S. application Ser. No. 12/148,522, filed Apr. 17, 2008, now U.S. Pat. No. 7,806,037 which in turn is a continuation-in-part of U.S. application Ser. No. 11/589,619, filed Oct. 30, 2006, now abandoned which in turn is continuation-in-part of U.S. application Ser. No. 10/924,431, filed Aug. 23, 2004 now abandoned

FEDERALLY SPONSORED RESEARCH

Not Applicable

SEQUENCE LISTING

Not Applicable

BACKGROUND OF THE INVENTION

The invention relates to protection of structures or other sites from blasts due to bombs or other explosive devices. The invention is particularly suitable for protecting buildings from car or truck bombs such as may be used in terrorist activities. The invention is equally applicable to any site requiring protection from ground level or low level explosive attack. In addition to blast protection, the invention is also applicable to protection from high velocity projectiles and debris associated with natural events such as hurricanes or tornadoes.

One common, worldwide method used by terrorist organizations is to use a bomb which is installed in a car, truck or other vehicle. The vehicle is driven adjacent to a target, and the bomb is then detonated in close proximity to the target. Examples of such attacks are the Oklahoma City federal building incident, the attack on the marine base in Beirut, multiple examples of IRA operations, and more recently a series of attacks on foreign interests in Saudi Arabia and the nightclub bombing in Bali. Clearly, vehicle bombing is employed for destructive ends by a wide variety of terrorist organizations all over the world.

However, existing means of blast protection are very difficult to use to protect most sites. Steel or concrete barriers must be extremely massive to be effective. For instance a concrete barrier adequate to protect against a 1500 lb truck bomb would have to be 7 feet thick or in the case of a solid steel wall, 14 inches thick. Clearly such barriers are not feasible to protect existing buildings in downtown city areas, where the streets may only be the width of a sidewalk from the building. Moreover extremely large barriers are very difficult and time consuming to fabricate and erect, making it impractical to provide blast protection from vehicle threats to existing buildings. Finally massive barriers are not aesthetic and architecturally harmonious with the vast majority of sites. Having to mar the appearance and functionality of sites to protect them from terrorism can be considered a victory for the terrorist in and of itself. Clearly, a more practical means of blast protection would be an important tool in the struggle against worldwide terrorism. The present invention provides a superior approach to site protection from blasts.

BRIEF SUMMARY OF THE INVENTION

The invention is a blast protection barrier, including an above and below ground portion constructed entirely or in part of a blast resistant composite, where the below ground portion anchors the barrier. The construction is preferably a fiber reinforced polymer matrix composite laminate (FRP). The barrier preferably consist of panels which are of a novel composition, detailed below. The panels when assembled into a barrier may also include external bracing, either angular, linear or both.

In a preferred embodiment, the barrier consists of sectional elements, arranged to form a pattern. One version of the pattern is, at least in part, the sectional elements arranged to form a continuous wall. In another version, the pattern is, at least in part, the sectional elements arranged in two or more rows to form a corridor. The corridor may be braced with cross pieces, the cross pieces having some degree of spring behavior. The cross pieces and corridor sections may be used as supports for signs, signals and sensors. In another version, the pattern is, at least in part, the sectional elements arranged to form a labyrinth or maze.

In another embodiment, the sectional elements include a portion providing lateral deflection of the blast and an overhanging portion providing at least partial vertical deflection of the blast. The barrier may also embody an entirely vertical wall. The sections may be colored and/or shaped to provide aesthetic and architectural value. Sections with curved shapes, both vertical and/or horizontal curved shapes, are contemplated.

In one embodiment a barrier panel is a composite laminate made from several layers or plies which make up the entire barrier thickness. The layers may be oriented at different angles with respect to one another. Each layer may utilize different fiber architectures, including but not limited to woven fabric, unidirectional tape, stitched reinforcement, or knitted reinforcement.

In a further embodiment, a barrier panel is a sandwich construction, of which at least one layer is the composite and at least one layer is a core material. The core materials in the sandwich may include but not be limited to, opened or closed cell foam, a honeycomb material, nomex, embedded I-beams of varying materials, or embedded composite pultrusions of constant cross-section along the length of the pultrusion.

In a further embodiment, a barrier panel is a hybrid laminate where part of the laminate total thickness uses the preferred type of composite laminate and the other part of the thickness uses a different type of composite laminate.

In a further embodiment, the barrier is a hybrid laminate utilizing different composite material plies or layers from one layer to the next in an inter-leaved fashion, where at least part of the layers are of the preferred type.

In a preferred embodiment, the cross section of the above ground portion varies as a function of height above ground level, and the function is determined by the requirement to provide adequate thickness in the region of expected higher blast loading for the intended application, and also provide less thickness in regions of lower blast loading in order to lower the overall weight of the barrier, compared to a barrier of constant cross section.

In a version of the preferred embodiment, the cross section of the below ground portion varies as a function of depth below ground level, and the function is determined by the requirement to provide adequate thickness in the region of expected higher blast loading for the intended application, and also provide less thickness in regions of lower blast loading in order to lower the overall weight of the barrier compared to a barrier of constant cross section.

In another embodiment the barrier may have a cross-sectional shape that is determined by other requirements beyond blast loading. For instance, the barrier may be thickest in an area that is potentially more exposed to kinetic or ballistic threats.

In one specific embodiment, the function that determines the cross-section may be a taper, where the barrier is thickest at ground level ant tapers toward the top, and, may taper below ground toward the bottom.

BRIEF DESCRIPTION OF THE DRAWINGS

The detailed description of how to make and use the invention will be facilitated by referring to the accompanying drawings.

DETAILED DESCRIPTION OF THE INVENTION

Figure 1:
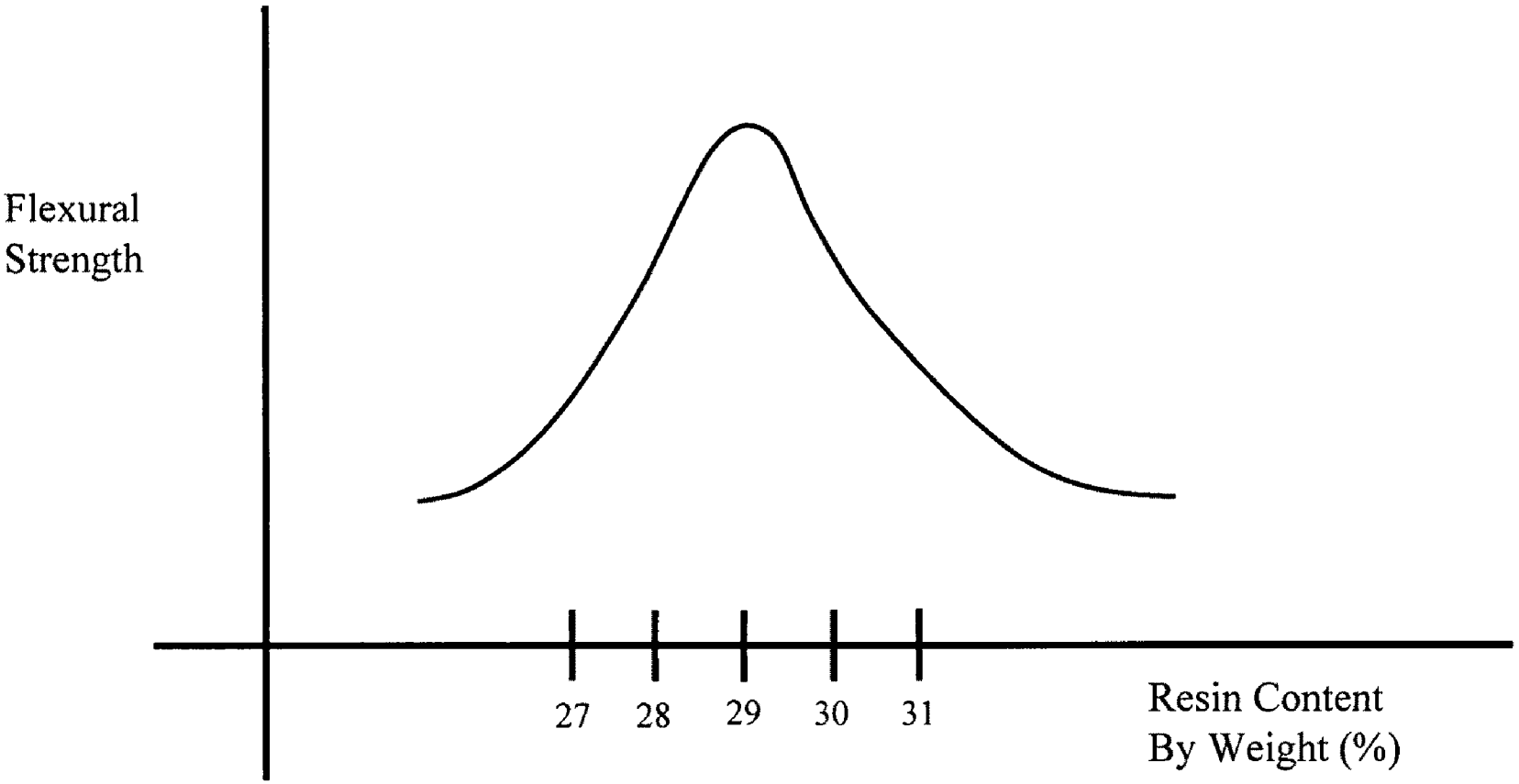
FIG. 1 shows the relationship between flexural strength and resin content for a selected fiber orientation

The inventors have produced a new concept for blast protection, enabled in part by employing very different materials than currently used for this application. Current materials such as reinforced concrete or armor steel rely on traditional mechanisms to absorb blast energy. Conventional materials have compressive strength properties which are inadequately low to effectively resist blast overpressures, requiring a large amount of material to absorb a blast. Thus barriers made of these materials are massive, heavy and expensive. A new class of materials enables a different approach. Such materials are similar to fiberglass in that they utilize a reinforcing fiber architecture which is infused with a polymer resin matrix, commonly known as FRP (Fiber Reinforce Polymer) composites. The most effective version of composite construction utilizes materials which exhibit high compressive and tensile specific strengths and high compressive and tensile specific moduli. Specific strength is defined as the ultimate compressive (or tensile) strength of the material divided by its density. Specific modulus is the elastic compression (or tensile) modulus of the material divided by its density. The polymer resin matrix is resistant to galvanic corrosion, solvents and chemical agents. These materials exhibit much higher resistance to blast per unit volume than concrete, steel or conventional FRP materials. Although composite materials have been contemplated for blast protection, suitable structural properties for the blast protection scenario have not been achieved to date.

Composite materials have been used for ballistic protection, such as in projectile-resistant armor. The ballistic resistant scenario requires that the composite resist spreading to complete failure as the projectile penetrates the material. As is known in the art, this result has been achieved by producing materials with a low resin content by weight. Such materials, although resistant to spreading, are weak structurally, ie they have low flexural strength. Thus these materials are generally used as a projectile-resistant layer over a structural base, such as a composite layer applied to steel in a military vehicle.

Conversely, blast resistance requires very high structural strength, well above the intended-use load bearing requirements for conventional composite structures such as boat hulls, car bodies and the like. The inventors have discovered that orienting a large portion of the fibers in a direction along the greatest anticipated flex axis, along with a much higher resin content by weight than used in conventional composites, results in a useful degree of blast resistance in a sufficiently thick composite structure. The inventors have produced 2" thick (8'H×10'L) composite panels with flexural bending strength of over 100,000 PSI in standard 3-point flexural tests without exhibiting premature splitting shear failure as a first ply failure mode. Such performance is believed adequate for many blast resistant applications. Such a structure would clearly also provide a degree of ballistic protection simply due to thickness, and as will be shown below, for certain formulations of the composite, the fibers may be treated in such a way that increases resistance to projectile spreading without losing structural strength. Such panels are a useful size to serve as sections of blast resistant barriers with a significant weight savings compared to concrete or steel barriers in addition to other significant beneficial characteristics, thereby demonstrating the applicability of the novel FRP composite structure as a blast barrier.

The fiber orientation for a blast resistant barrier preferably is oriented along the bending axis anticipated, which for a barrier embedded in the ground is the vertical axis. Only the minimum necessary to keep the structure together in the other axis is desirable or to handle other requirements. Controlling weave geometry to achieve alignment in multi layer laminates is not common, which is one reason existing composites are not effective blast barriers. To achieve the desired novel construction, weave has to be procured with a given orientation, and then the weave has to be applied to maintain that orientation as each ply is built up, up to 40 or more plies. Although a range of fiber orientations will deliver useful results, the inventors have found that a 89% vertical, 11% horizontal fiber weave is near optimum for a blast barrier application, while as little as 50% in the vertical direction is still beneficial. In order to make a thick laminate, 2" or more, several layers of fiber weave are needed, close to 40 for some tested versions the inventors have produced. The inventors have also found that fiber weight per layer greatly affects the amount of resin which can be carried by the laminate. Therefore one parameter necessary to achieve the required resin content is fiber weight per layer. A Fiber Area Weight FAW in the mid 50 oz./sq. yd. range has been found effective The inventors have to date made panels using E-glass fiber. S2-glass is also a possibility, more expensive but less thickness and weight for the same flexural strength. The use of S2 glass also allows for the treatment of the fibers with sizing agents that increase the fiber-resin bond, and give the composite better resistance to significantly better ballistic penetration with some reduction in flexural strength. An example of such a sizing agent is Gamma-Aminopropyl Triethoxysilane.

FIG. 1 shows the strong dependence of flexural strength on resin content percentage. Clearly greater than 28%, and ideally 29-30% is required. Such resin content is not common, and the inventors have identified several key process parameters to achieve such high resin content, using a vacuum infusion process. First the resin viscosity for a suitable resin such as a vinyl ester for E2 glass should be relatively low to allow for adequate wet-out through the thick ply structure. A rule of thumb is that the resin should fully drain from a resin test cup, as known in the art, in 35 minutes or less. Also an inhibitor, such as Hydroquinone should be used to delay resin gellation until full ply wet-out is achieved. The inhibitor should be added sufficient to delay gellation until at least 20 minutes after the panel form is completely filled. A resin suppler can be asked to determine inhibitor/catalyst/resin concentrations for a given form volume and desired fill-time. Finally the temperature should be controlled of the resin during fill to assure that gellation is achieved before resin is pulled by the vacuum system. Thus monitoring the pull-line for resin and increasing the fill temperature if necessary to keep resin from pulling before full gellation also contributes to higher resin content. The combination of the proper choice of ply weight, resin viscosity, inhibitor/catalyst concentration, and control of fill/gellation time achieved resin contents of over 29%, and panels of very high flexural strength. It has also been found that adding A-glass veil layers to each ply helping resin take-up. The veils are less than 10% of the mass of the fibers in the material, comprised of highly uniform, randomly distributed filaments bonded with a soluble thermoset polyester.

A specific example of a panel which achieved flexural strength of approximately 100,000 psi is described. The panel was made of an E-glass/Vinyl Ester thick laminate of thickness 2", exhibiting an E-glass fiber content of at least no more than 71% by weight. The laminate has 89% of the fibers oriented in the long (i.e. height direction) and 11% of the fibers oriented in the transverse (i.e. width direction). The number of plies of reinforcement was approximately 39. In order to maximize the structural load bearing capability of the blast resistant FRP laminate, the fiber reinforcement had a vinyl ester compatible surface treatment in order to maximize the fiber-to-resin bond strength. The FRP blast panel was fabricated using the Vacuum Infusion Process (VIP) achieving at least 29% by weight and a cured laminate void content of less than 0.5% by volume. A pre-catalyzed vinyl ester resin was used to infuse the panel. The glass transition temperature of the resin, as measured by Dynamic Mechanical Analysis (DMA), was least 290° F. in order to withstand extreme hot and cold operating service temperatures. The viscosity of the resin was less than 230 cps at 77° F. in order to accomplish full and complete wet-out of all reinforcing fibers during vacuum infusion. The resin gellation time was less than 110 minutes in order to avoid polymerization of the resin prior to achieving complete wet-out of the reinforcing fibers. The FAW of the fiber pies was 55.53 oz/sq yd. In one version, each ply included an A-glass veil, 10 mils thick with FAW of 10.8 oz/sq yd.

Figure 2:
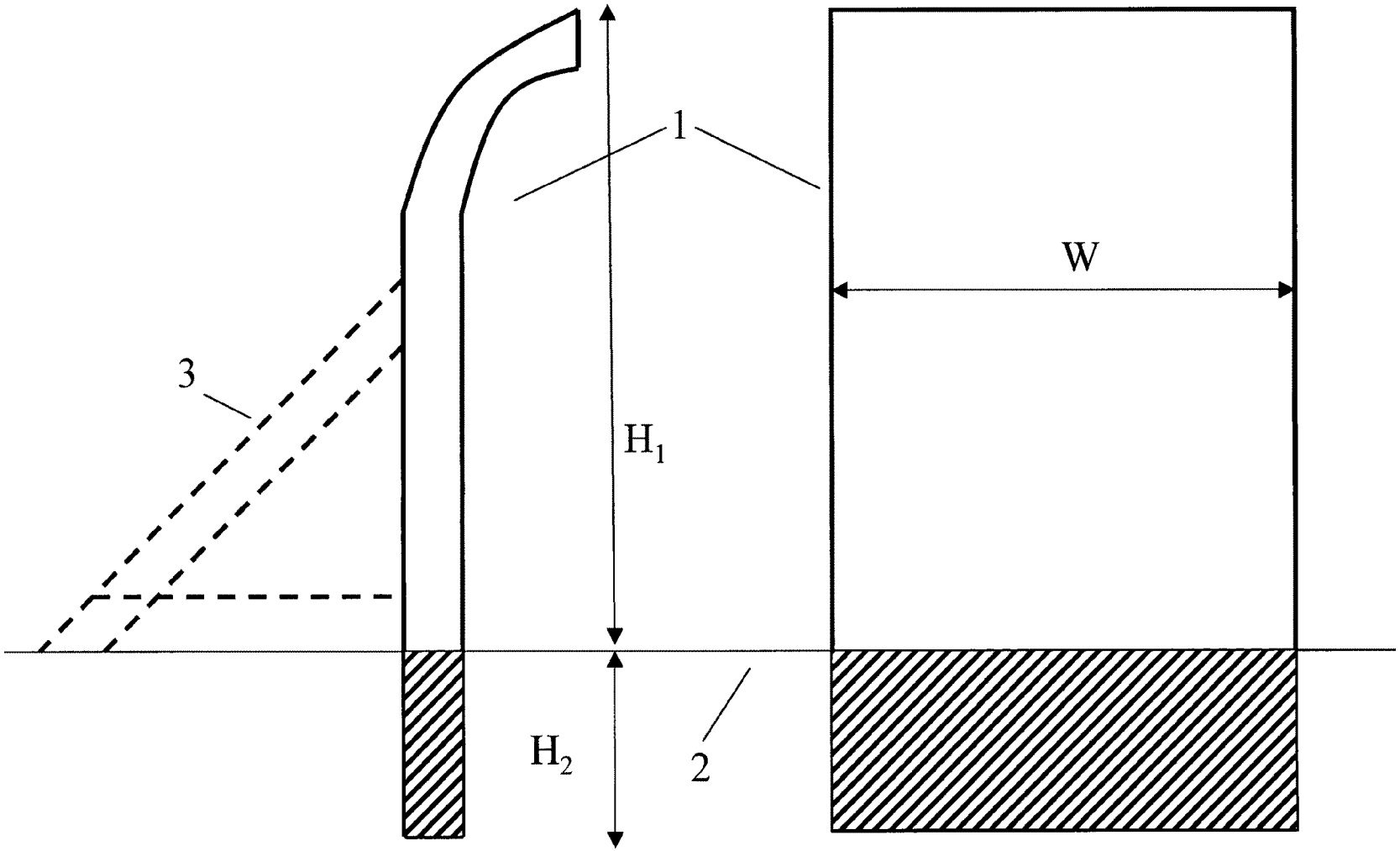
FIG. 2 shows a blast barrier according to the invention

Referring to FIG. 2, a preferred implementation of the invention is shown. A section of a blast barrier 1 consists of a portion $H_1$ above the ground 2 and a portion $H_2$ below ground. The composite barriers may be constructed and assembled as a continuous wall or as staggered discontinuous segments allowing walk through spaces for pedestrian traffic. The above ground portion is at least partially constructed of a composite of the type described above. The below ground portion, which anchors the section against the blast overpressure, does not have to be of composite construction. It may be preferable to use a heavier material for the anchor, and such an approach is contemplated by the invention. The above ground portion may be a variety of shapes. One particularly useful shape, as shown in FIG. 1 is to have the upper portion curve near the top to create an overhang. The overhang provides improved containment of the blast overpressure. Although the invention is not constrained by the actual dimensions, the inventors have found that a useful size for handling the sections is a height, $H_1$, of 10' (3.05 m) or higher, a height, $H_2$, of 5' (1.52 m) and a width, W, of 10' (3.05 m). Such dimensions allow for a manageable number of sections to surround a building, enough height to protect against truck bombs, and a weight of under 6 tons (5359 kg) which is easily handled by small scale construction equipment and small work crews. The composite material has a large resistance to blast energy. Typically the limit to how big a blast can be withstood will be the ability of the anchoring to keep the barrier from rotating out of the ground. For larger threat scenarios, it may be advantageous to increase the barrier's ability to withstand blasts by increasing $H_2$ or by adding additional bracing 3 (either cross or horizontal or both) as shown in FIG. 1.

Figure 3:
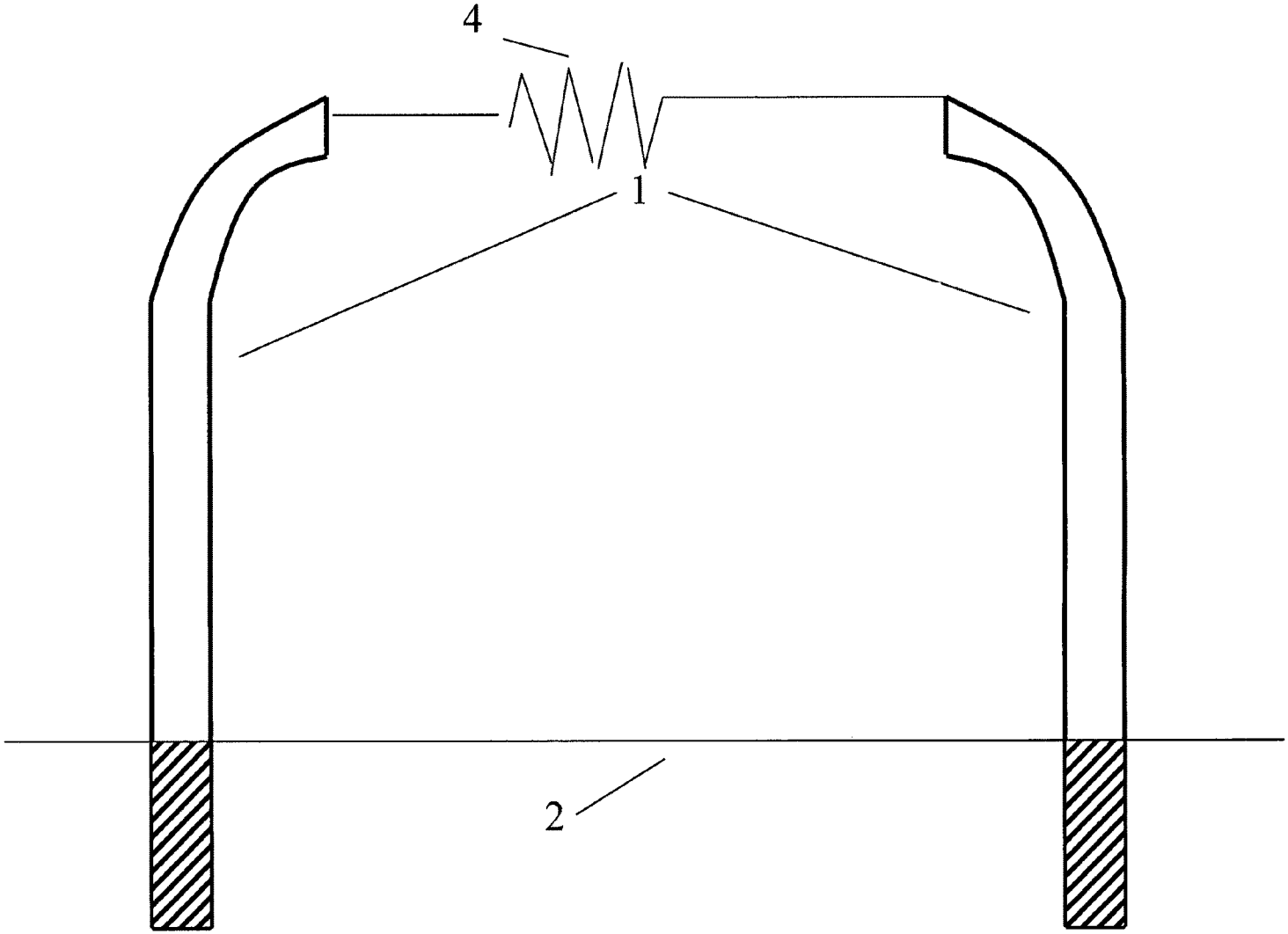
FIG. 3 shows one possible implementation of the invention.

Alternatively, as shown in FIG. 3, the sections may be arranged to form a corridor with walls on both sides of the roadway. Additional protection may be added with cross bracing as shown in FIG. 1, or by means of ties across the barriers, shown at 4. These ties must have some stiffness indicated by the spring at 4. When a bomb is detonated in the corridor between two barriers, the outward blast pressure exerted on both barriers, develops tensile forces in the ties at 4. One use that can be made of either the barriers or ties is that they can be used as supports for road signs, traffic signals or sensors.

Figure 4E:
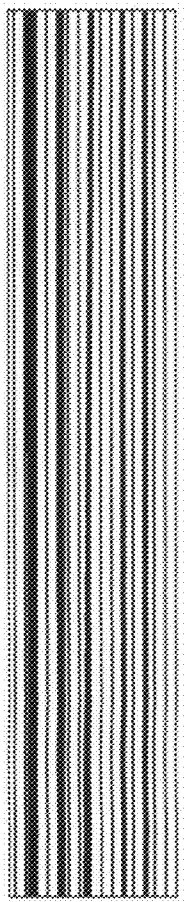
FIG. 4 shows several examples of barrier construction according to the invention.
Figure 4D:
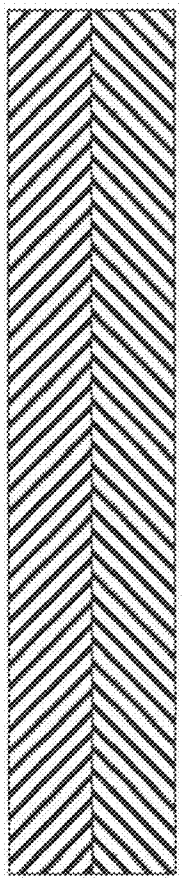
Figure 4C:
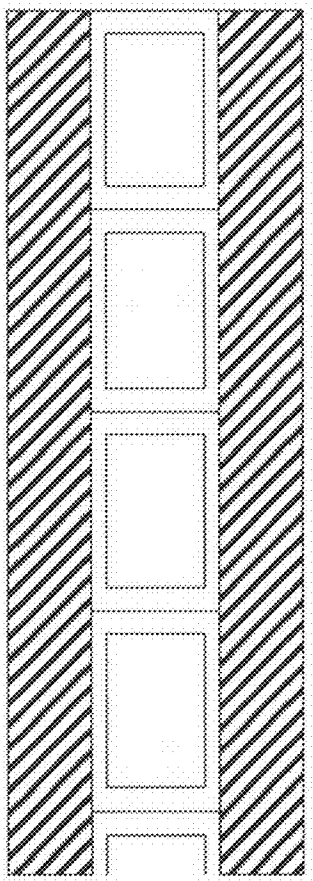
Figure 4B:
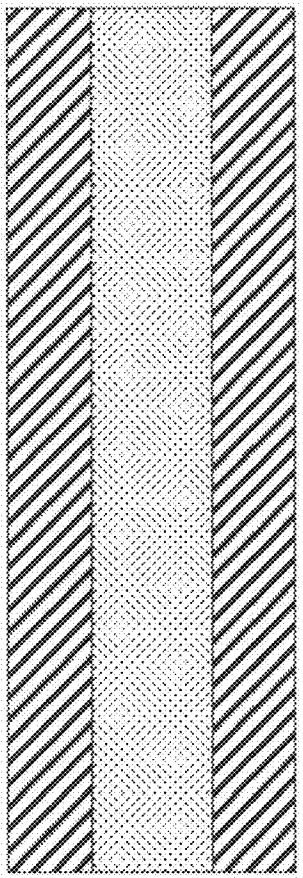
Figure 4A:
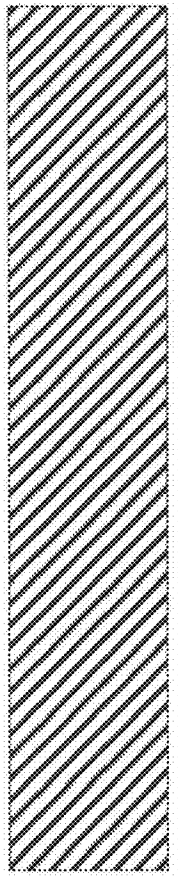

Although the preferred composite must be used to obtain the required amount of blast protection per thickness, it may be advantageous to have other materials in the section as well. Other materials may be useful to provide additional benefit beyond blast protection. Such benefits include acoustic control, outer appearance, or firm connection to a different anchoring material. Also some combinations of material provide increased blast resistance, with weight and thickness trade-offs. FIG. 4*a* shows the simplest case in which the barrier is a composite laminate where each ply is the same material. As shown in FIG. 4*b*, the barrier may be of sandwich construction, where at least one layer is the composite and at least one layer is a core material. The core materials in the sandwich may include but not be limited to, opened or closed cell foam, aluminum honeycomb, nomex, embedded I-beams of varying materials, or as shown in 4*c*, embedded composite pultrusions of constant cross-section along the length of the pultrusion. FIG. 4*d* shows the barrier as a hybrid laminate, where a portion of the laminate total thickness uses one type of composite laminate and the other portion of the thickness uses a different type of composite laminate. In 4*e* the barrier is a hybrid laminate utilizing different composite material plies or layers from one layer to the next in an inter-leaved fashion.

Figure 5:
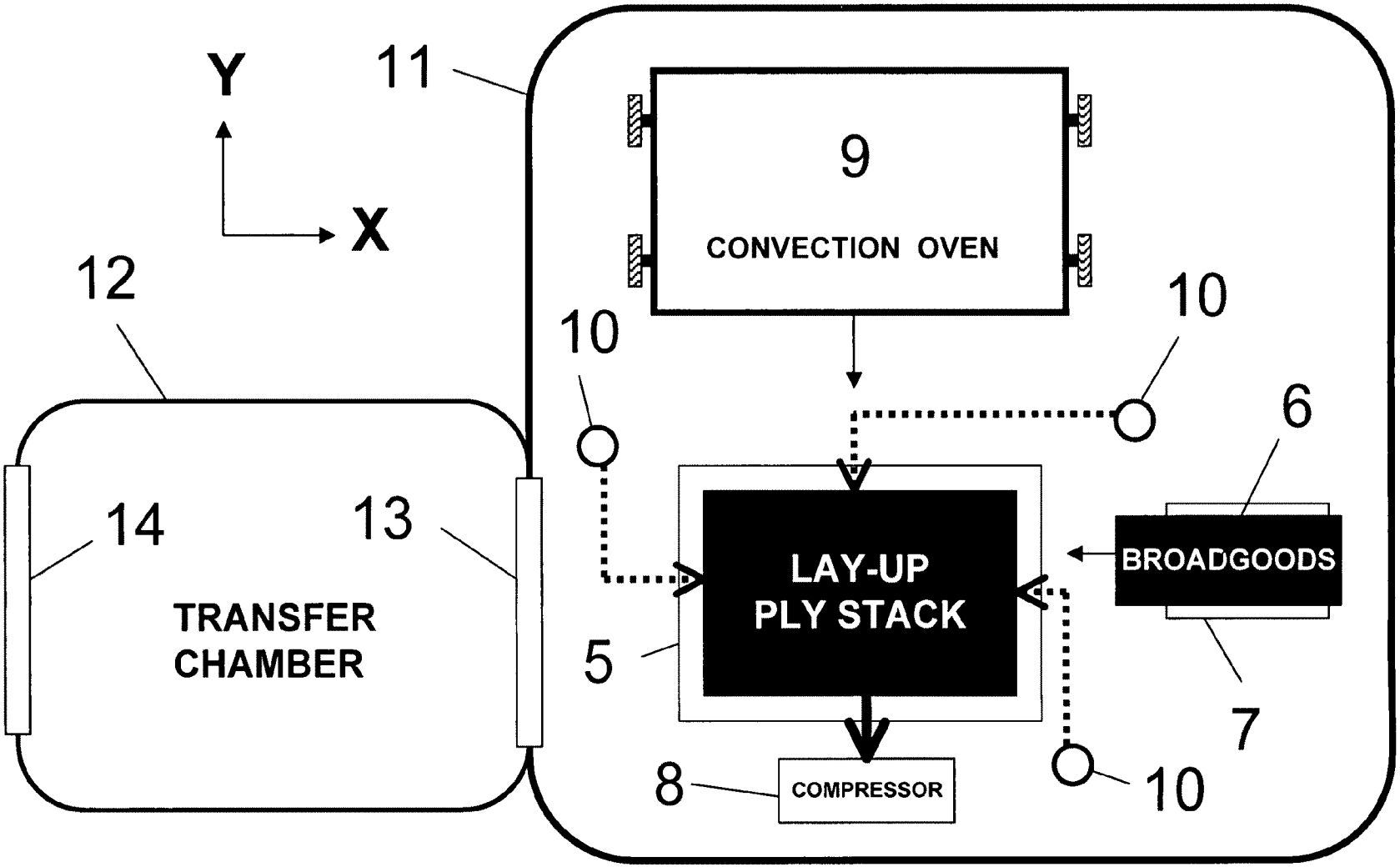
FIG. 5 illustrates a method for on-site construction of the novel barriers

A particularly useful aspect of the invention is lightweight nature of the material and the relative ease with which segments may be fabricated and handled, permitting on-site construction of barrier segments. If, for example, it is desirable to retrofit an installation in a remote location, such as a military base in the Middle East, it is much more convenient to ship barrels of resin and rolls of reinforcement than to ship hundreds of wide, 6 ton, prefabricated sections. As long as a semi-controlled environment can be created and a forming tool available, the blast protection sections may be easily fabricated and assembled on-site. An example of an on-site fabrication facility is shown in FIG. 5. The elements shown in FIG. 5 must be in a relatively clean, air conditioned, temperature and humidity controlled environment. The inventors contemplate housing the facility in an enclosure, such as an air filled, positive pressure, fabrication tent. The elements include 5, a stationary lay-up tool. Broadgoods 6 are unrolled from the payout drum 7 and deposited on the lay-up tool, 5. The payout drum moves back and forth in the y direction to deposit broadgoods along the entire length of the lay-up tool, 5. A Compressor 8 draws one Atmosphere of vacuum for ply stack debulking (i.e. consolidation of stacked plies). The Compressor is also used for Resin Infusion if the Tool is stacked with dry Broadgoods rather than prepreg. The Convection Oven 9 rolls in the Y direction and can be raised and lowered over and onto the stationary Tool for Laminate Curing when Prepreg Broadgoods are used. The Oven consists of five insulated walls and a heater with a recirculating forced air blower. Resin drums and infusion lines 10 facilitate the resin infusion of the dry stack of Broadgoods. The facility may be housed in an inflatable, positive pressure, air conditioned Tent 11 with temperature and humidity control. A Positive Pressure Transfer chamber 12 is used to prevent loss of positive pressure in the fabrication Tent when removing the cured part from the Tent. After the cured part is moved into the pressurized transfer chamber, the Passageway 13 is sealed to prevent loss of pressure in the fabrication Tent. Only after sealing Passageway 13 is the Transfer Chamber Exit 14 allowed to be opened.

The facility may include a vacuum assisted resin infusion capability. The vacuum being drawn on the bag sucks air out of the bag while sucking resin into the bag and simultaneously serves to consolidate the layers of reinforcement. The resin contains a catalyst, which initiates the curing of the consolidated stack of plies at ambient temperature. Alternatively, the inventors believe a pre-impregnation technique is preferable. In a further embodiment of the method, the reinforcing fiber is pre-impregnated (commonly referred to as prepreg) with partially cured (i.e. B-staged) resin while still in broadgoods tape or woven fabric form. A release film is applied to the prepreg broadgoods which is peeled off prior to the stacking of prepreg layers onto the Tool or mold. The prepreg stack is intermittently consolidated (i.e. debulked) by vacuum bagging until the required number of plies are deposited onto the Tool. The ply stack is vacuum bagged and oven cured to net thickness. This approach eliminates the need for using wet resin during the fabrication of barrier segments. The sections may be produced and cured in the on-site fabrication tent and moved and installed easily by a small work crew.

Figure 6:
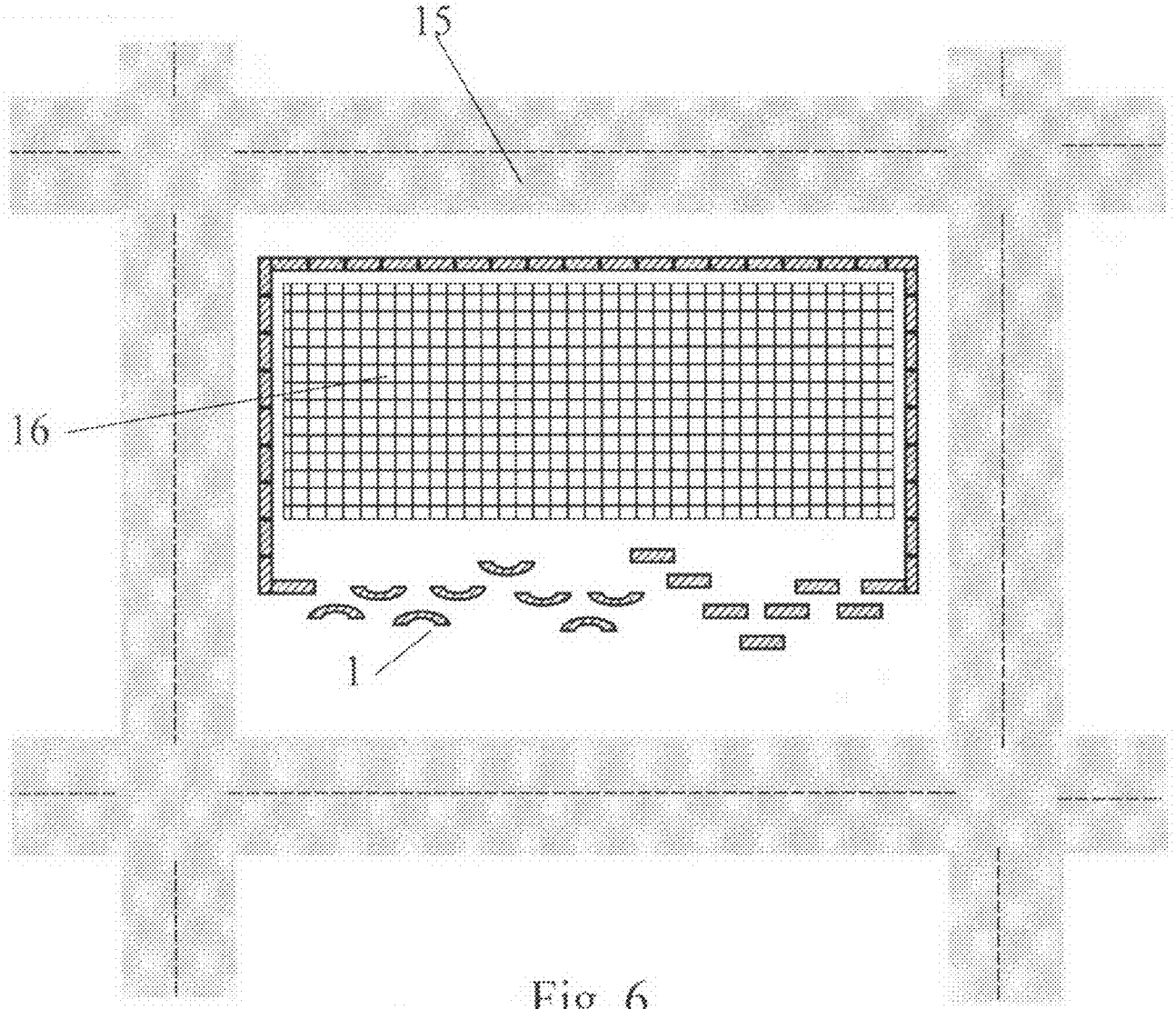
FIG. 6 illustrates how the invention may be used to practically protect existing sites in crowded city environments.

Referring to FIG. 6 the advantages conferred by the invention to practical site protection are shown. Many professed terrorist targets are existing financial and government facilities in cities. Such facilities are almost impossible to protect from street level threats with existing methods. Moreover, where protection is possible the massive and unattractive current blast barriers are a constant reminder that terrorism has in fact negatively impacted every day life. FIG. 6 shows an exemplary city block street grid 15 surrounding a potential target building 16. Most of the building will typically be adjacent to the streets. As shown by example in FIG. 6, three sides are separated from the streets by a sidewalk. Often, important buildings have a front facade that may be set back from the streets. Often the front includes some open space, and possibly several floors of open volume with glass fronts. Due to the facade and entry way, the building front is usually the most vulnerable part of the building and thus becomes the preferred location of terrorist attack using street level explosives. The open space in front may allow for some stand-off, such as commonly employed vehicle drive obstruction posts, which provide no blast protection. Using current techniques however, the perimeter of the building adjacent to the street cannot be protected at all. Thus, even though the sides of an unprotected building are typically stronger than the front, the sides present an unprotected target for attack by simply using a bigger bomb than required for the front. Insufficient space is available to install conventional type blast barriers on most parts of a city building. However, the current invention easily permits the installation of a blast barrier wall, using 7.5 inch (19.05 cm) thick sections 1, around the building without significantly impeding normal street and sidewalk usage.

The building front, with an open space and glass wall, may possibly have room for massive barriers. However, the implementation of such barriers is difficult from a construction standpoint and extremely unattractive. The novel barrier sections 1 arranged in a maze or labyrinth can be designed to allow free flow of pedestrian traffic through the offset sections, and still provide effective blast protection. The sections 1 may be designed in shapes and colors that enhance the architecture and surroundings. FIG. 6 shows both straight and curved barrier segments, however, many shapes are possible and within the scope of the invention. The inventors believe that 360 degree all around protection could be installed with little impact on normal building operation or the surrounding environment. Although the city scenario is possibly the most advantageous implementation of the invention, rapid on-site fabrication and deployment ease applies even to sites that may have room for massive barriers.

As described above, minimizing the weight of the barrier sections while maintaining an adequate measure of protection is an important consideration in the use of blast barriers. Although the materials proposed herein for the novel barriers allow for much lighter barrier sections than conventional materials, depending on the nature of the anticipated threat to a particular installation, it is possible to further reduce the weight of the barriers. For many scenarios, the loading on the barriers due to anticipated blast threats will not be constant along the height of the barrier above ground. This situation allows for flexibility in setting the thickness of the barrier as a function of height.

Figure 7:
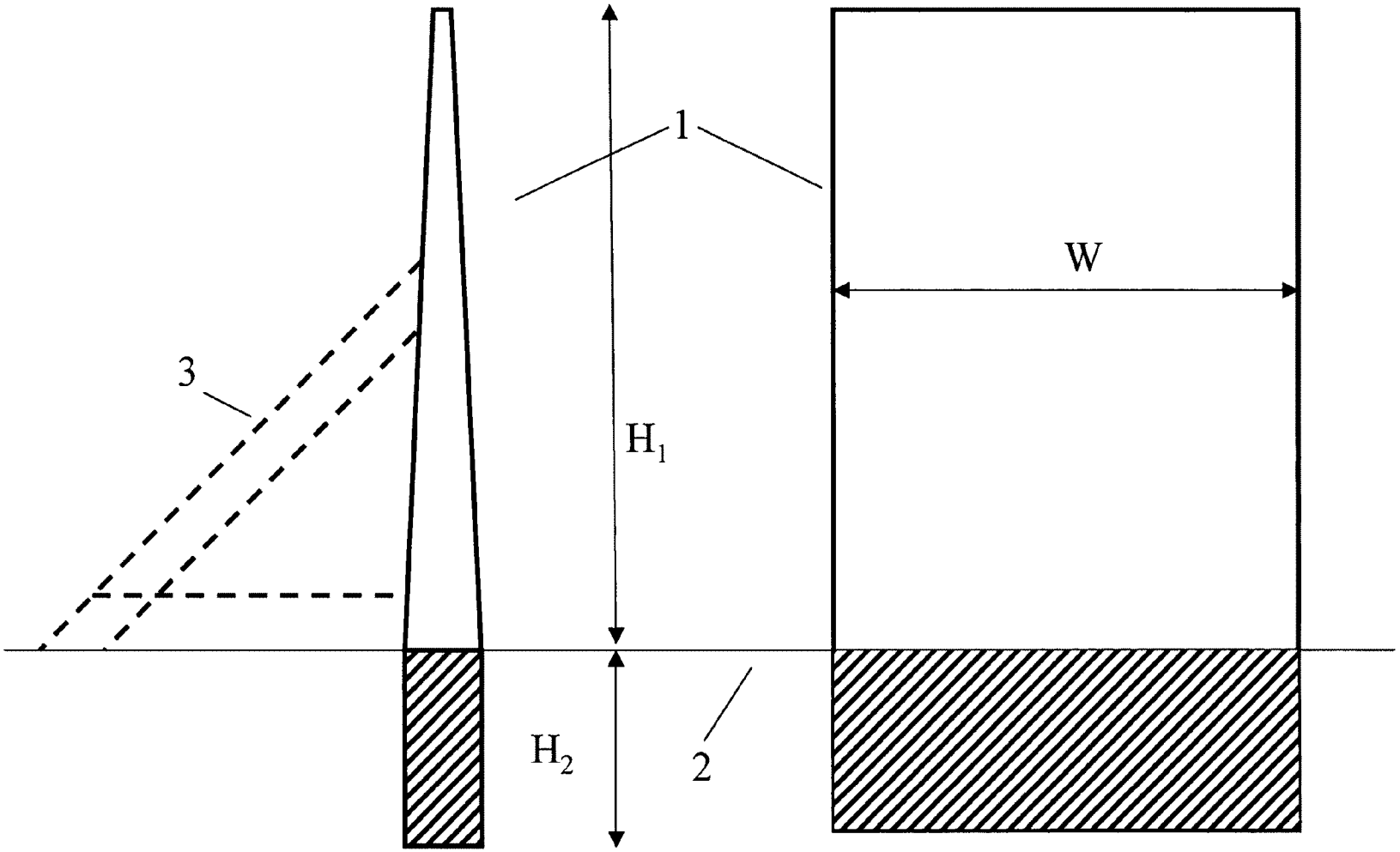
FIG. 7 shows a preferred embodiment of the invention

FIG. 7 illustrates an example of a possible approach to minimizing weight of a barrier. Above ground portion 1 is shown as tapering from ground level from a thickest point to a thinnest point near the top. If the blast is expected to occur at a low height, such an approach provides highest loading resistance where the expected intensity is highest. Such a barrier would be much lighter than a barrier whose thickness was constant along the height with the thickness set by the highest loading intensity.

Figure 8:
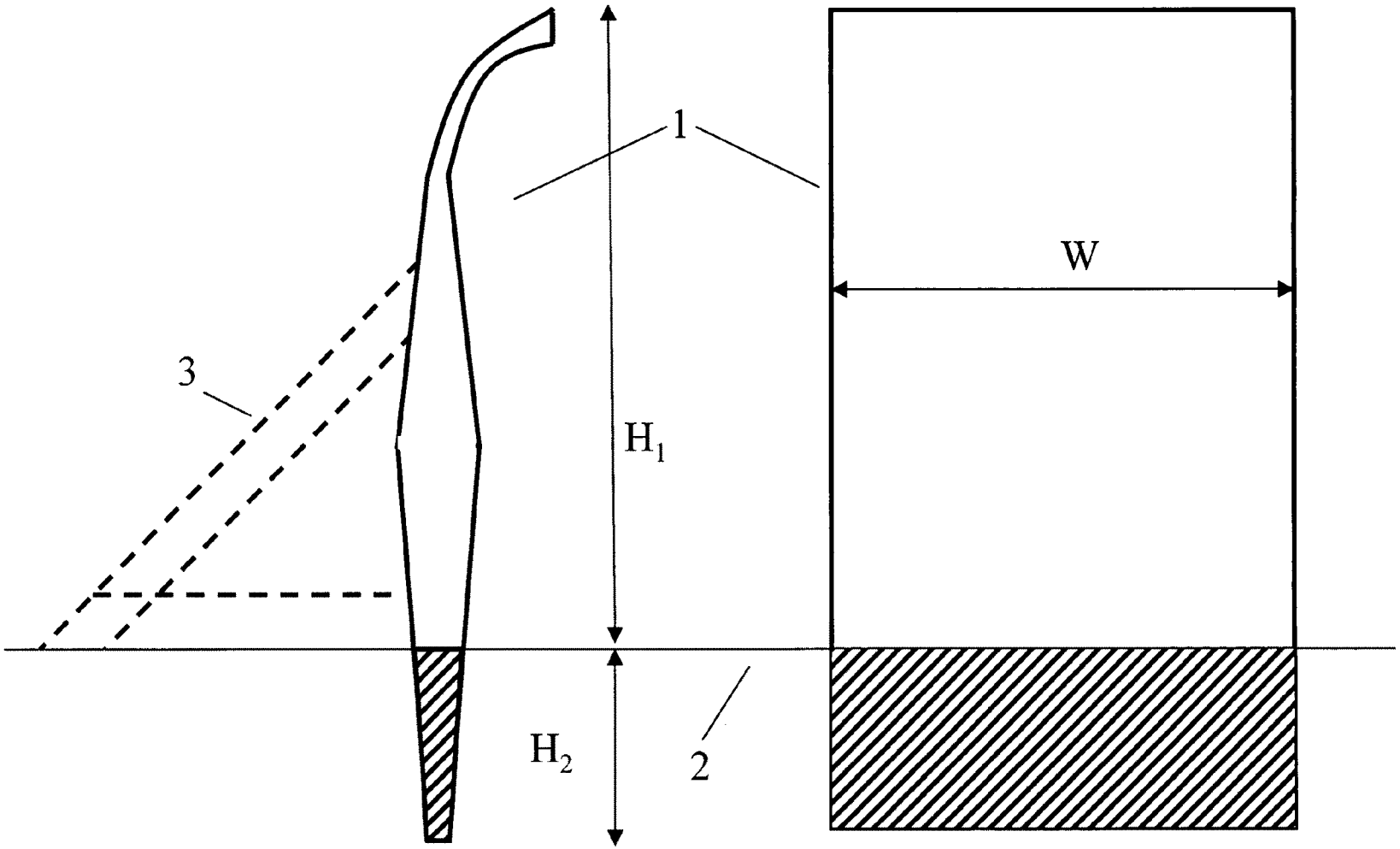
FIG. 8 shows a version of the preferred embodiment

As shown in FIG. 8, similar logic may be applied to the below ground portion 2, which again may be configured to be thickest in the area of highest loading, and thinner elsewhere. Moreover, either portion 1 or 2 need not be shaped as a simple taper, but may assume other cross-sectional shapes, determined by a function whose purpose is to provide adequate resistance in regions of anticipated higher loading and thinner cross section in areas of lower anticipated loading, such that the result is adequate loading resistance along with lower weight. Also shown in FIG. 8, the above ground portion may also have an overhang in the variable cross section implementation as well as in a constant cross-sectional implementation. The barrier may also vary in cross-section due to concerns other than blast loading. For instance the part of the barrier most likely to experience kinetic or ballistic threats, such as being rammed by a vehicle, may be above ground. The above-ground shape in FIG. 8 is a possible approach to a kinetic threat, whereby the thickness is adequate for a blast threat overall, but has a thicker section at a height deemed to be exposed to a kinetic threat. Other shapes, such as curved, or logarithmic, are also possible and are within the scope of the invention.

We claim:

1. A blast protection barrier, comprising:

at least one panel made of a Fiber Reinforced Polymer (FRP) thick laminate, fabricated using the Vacuum Infusion Process, the laminate characterized by:

the laminate thickness resulting from a plurality of plies, a resin content of at least 28% by weight; and, greater than 50% of the fibers oriented in the long (height) direction, with the orientation maintained in each ply of the laminate.

2. The panel of claim 1 wherein;

the laminate comprises a sizing agent to increase the fiber-resin bond.

3. The panel of claim 2 wherein the fiber material is S2 glass.

4. The panel of claim 3 wherein the sizing agent is Gamma-Aminopropyl Triethoxysilane.

* * * * *